US005924301A

United States Patent [19]

Cook

[11] Patent Number: 5,924,301

[45] Date of Patent: Jul. 20, 1999

[54] APPARATUS FOR ICE HARVESTING IN COMMERCIAL ICE MACHINES

[76] Inventor: Richard E. Cook, 712 Kolb Rd., South Houston, Tex. 77587

[21] Appl. No.: 08/929,201

[22] Filed: Sep. 9, 1997

Related U.S. Application Data

[51] Int. Cl.[6] ..... F25C 5/10

[52] U.S. Cl. ..... 62/347; 62/352

[58] Field of Search ..... 62/347, 348, 352

[56] References Cited

U.S. PATENT DOCUMENTS

| | | | |
|---|---|---|---|
| 3,430,452 | 3/1969 | Dedricks et al. | 62/347 |
| 4,366,679 | 1/1983 | Van Steenburgh, Jr. | 62/347 |
| 4,448,598 | 5/1984 | LaMonica et al. | 62/352 |
| 4,843,827 | 7/1989 | Peppers | 62/73 |
| 4,907,415 | 3/1990 | Stewart, Jr. et al. | 62/347 |

*Primary Examiner*—William E. Tapolcai
*Attorney, Agent, or Firm*—Jackie Lee Duke

[57] ABSTRACT

An apparatus for restoring the efficiency of ice cube making machines with a vertically oriented evaporator plate is disclosed. These evaporator plates have a series of ice cube molds arranged in a lattice pattern on one side of the evaporator plate and a refrigerant coil attached to the other. The ice cube molds are of a generally square or rectangular cross section with the lower face being either horizontal or tapered downwardly to facilitate ice harvesting. The apparatus is a piece of low friction plastic material shaped to fit the lower face of the ice cube mold. This forms a low friction surface or skate which allows the ice harvesting to be restored to its original efficiency.

10 Claims, 3 Drawing Sheets

APPARATUS FOR ICE HARVESTING IN COMMERCIAL ICE MACHINES

BACKGROUND OF THE INVENTION

1. Field of the Invention

This invention relates to an improved apparatus for increasing productivity of ice cube making machines and more specifically to an improvement in the evaporator plate in such machines.

The making of cube ice for commercial applications, such as hotels and restaurants, differs considerably from the process used in refrigerators found in the typical home. In the case of home refrigerators, trays with ice cube molds formed therein are filled with water by the consumer and placed in a section of the refrigerator, "the freezer", which is maintained at a sufficiently cold temperature to cause the water to freeze and form ice cubes. Those refrigerators with "ice makers" built in to the freezer section of the refrigerator use the same technique with the addition of a water supply line for automatically filling the ice tray, a mechanical apparatus for dumping the ice from the tray when it is formed and a timer for controlling the process.

The commercial ice cube making machines noted above use a different apparatus and methodology. These machines use a metal plate with pockets or ice cube molds in an "egg crate" or lattice structure formed on one side and refrigerant coils formed on the other side. This plate is called an evaporator plate and is formed of copper with a nickel coating to ensure good heat transfer between the two sides of the plate. The evaporator plate can be in a horizontal or vertical position. Water is allowed to trickle across the face of the lattice structure side of the evaporator plate while a refrigerant gas is flowing through the refrigerant coils. This causes the evaporator plate to be chilled and subsequently causes the water to freeze within the ice cube molds of the lattice structure. The ice making process is complete once the pockets or ice cube molds are full of ice and a solid bridge of ice connects each individual ice cube to form a solid slab with all ice cubes connected. The formation of this solid ice structure is necessary to facilitate the removal of the ice cubes from the evaporator plate or "harvesting" of the ice as it is known in the industry.

Harvesting of the ice is accomplished by reversing the flow of refrigerant gas through the refrigerant coil thereby causing a temporary heating of the evaporator plate and lattice structure. This causes the ice cube "block" described above to unthaw slightly and fall from the evaporator plate. As noted above, the evaporator plate may be positioned in a horizontal or vertical position. The designs which place the evaporator plate in a horizontal position place the ice cube molds on the lower face of the plate and depend on gravity to harvest the ice cubes. Those designs which place the evaporator plate in a vertical position use either a mechanical probe to urge the ice block from the lattice structure or the lower face of the individual ice cubes molds is sloped downwardly to aid gravity in harvesting the ice. It is these designs which use a vertically oriented evaporator plate to which the present invention is directed.

As noted previously, the evaporator plate and lattice structure is constructed from a highly conductive metal such as copper to give superior heat transfer characteristics. The copper base material is then coated with nickel or similar metal to enhance this heat transfer characteristic and provide a smooth, abrasion resistant surface texture. In a new machine this arrangement works quite well. The ice is quickly formed on the evaporator plate during the freezing cycle and then efficiently harvested as described above. Unfortunately, as the cycles of freezing and harvesting ice build, the smooth, abrasion resistant surface becomes worn with rough spots, pits and in some cases the nickel coating completely eroded. This rough surface texture in the individual ice mold pockets causes the ice block to stick or hang in the molds when ice harvesting is attempted. The sticking of the ice slab forces the heating or harvesting cycle to be extended thereby causing increased melting of the individual ice cubes before the slab will loosen and fall from the evaporator plate. The result is partially melted cubes, increased cycle time, and decreased production of ice cube volume.

The current solution to rectify this decreased production problem is to clean the surface of the individual ice molds with a chemical cleaner. This takes considerable time on the part of the technician and gives only a slight increase in ice cube production and is a temporary fix at best. Replacement of the evaporator plate is not a viable solution owing to the method of attachment of the refrigerant coil and the cost involved. The present invention solves these problems in a simple, cost effective manner to allow the ice cube making machine to operate at peak efficiency, thereby providing considerable cost savings to the owner.

2. Description of Related Art

Various types of methods and apparatuses to aid in the formation and harvesting of ice have been shown and used.

U.S. Pat. No. 4,366,679 to L. R. Van Steenburgh, Jr. shows a vertically disposed evaporator plate design which uses a different refrigerant coil design in combination with a mechanical probe to help ice harvesting.

U.S. Pat. No. 4,448,598 to G. LaMonica et al. reveals a system for ice harvesting that uses heating of the evaporator plate with a pneumatic system for separating the ice from the evaporator plate.

U.S. Pat. No. 4,843,827 to J. M. Peppers discloses a vertical evaporator plate design that uses heating of the evaporator plate in combination with a sonic or ultrasonic frequency vibration to assist in ice harvesting.

SUMMARY OF THE INVENTION

The improved apparatus for ice harvesting of the present invention, called a "skate", is designed for use in an ice cube making machine which utilizes a vertically oriented evaporator plate with the ice cube molds arranged in a lattice pattern on one side of the evaporator plate and a refrigerant coil attached to the other. The ice cube molds are of a generally square or rectangular cross section with the lower face being either horizontal or tapered downwardly to facilitate ice harvesting. The skate is a piece of low friction plastic material shaped to fit the lower face of the ice cube mold and typically 1/16" thick. The skate is attached to the lower face of the ice cube mold with a water proof adhesive. A typical lattice pattern will require only four of the skates to be installed to allow the ice harvesting to be restored to its original efficiency.

It is a principal object of the present invention to provide an improved apparatus for ice harvesting in machines with a vertically oriented evaporator plate that can be retrofitted to the evaporator plate to minimize excessive melting of the ice cubes during harvest.

Another object of the present invention is to provide an improved apparatus for ice harvesting in machines with a vertically oriented evaporator plate to restore the evaporator plate production efficiency.

A final object of the present invention is to provide an improved apparatus for ice harvesting in machines with a vertically oriented evaporator plate that is low cost and simple to maintain.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1:
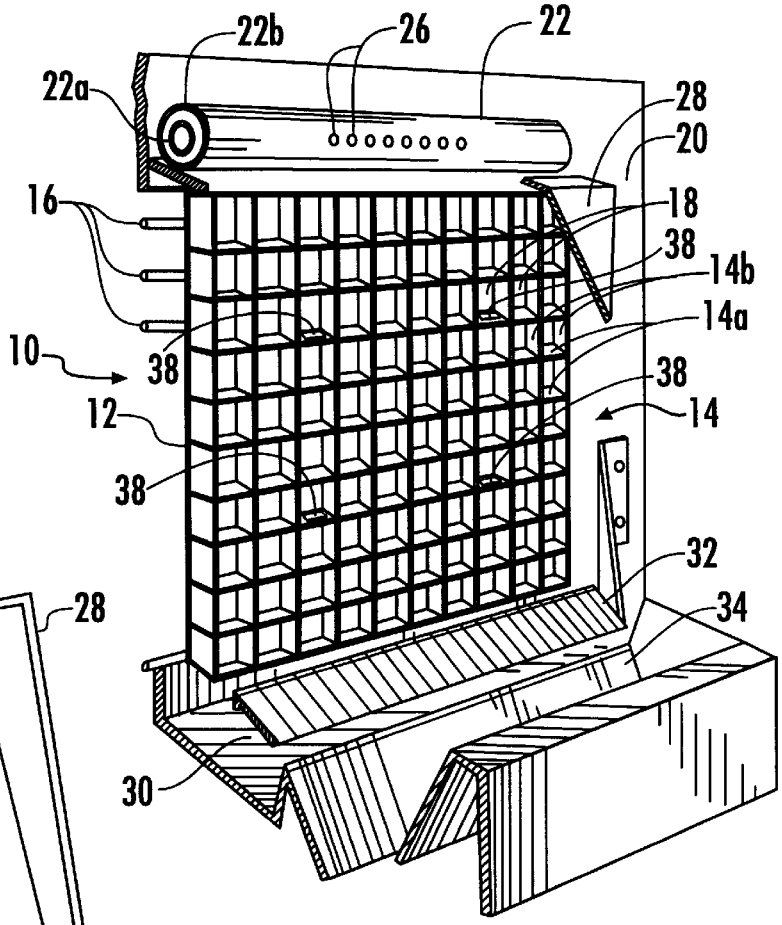
FIG. 1 is a perspective view of an ice cube making machine with a vertically oriented evaporator plate with the improved apparatus of the present invention or skate installed.

With reference to the drawings, and particularly to FIG. 1, a perspective view of an ice cube making machine with a vertically oriented evaporator plate is shown with the improved apparatus of the present invention or "skate" installed. The ice cube making machine 10 includes a vertically oriented evaporator plate 12 with an "egg crate" or lattice structure 14 attached to its front side. A serpentine shaped refrigerant coil 16, well known to those of ordinary skill in the art, is secured to the back of evaporator plate 12 by suitable means as soldering. The evaporator plate 12 is formed of copper plate with a nickel coating to provide abrasion resistance. The lattice structure 14 is formed of horizontal walls 14*a* and vertical walls 14*b* to form individual pockets or ice cube molds 18.

The evaporator plate 12 with lattice structure 14 and serpentine shaped refrigerant coil 16 attached are supported by support frame 20. Support frame 20 has water delivery tube 22 attached to it immediately above lattice structure 14 and spanning the length of lattice structure 14. Water delivery tube 22 includes inner tube 22*a* and outer tube 22*b* arranged to deliver water to lattice structure 14 through holes 24 and 26 in a manner to be described hereinafter.

Cover plate 28 is mounted on support frame 20 and pivots about its upper edge. Cover plate 28 is normally in a generally vertical position to prevent splashing of water as it flows across lattice structure 14 and direct the flow of water to reservoir 30 positioned below evaporator plate 12. An ice deflection grate 32 is placed over reservoir 30 to direct ice cubes into a guide chute 34 that directs the cubes to a storage bin (not shown).

Figure 2:
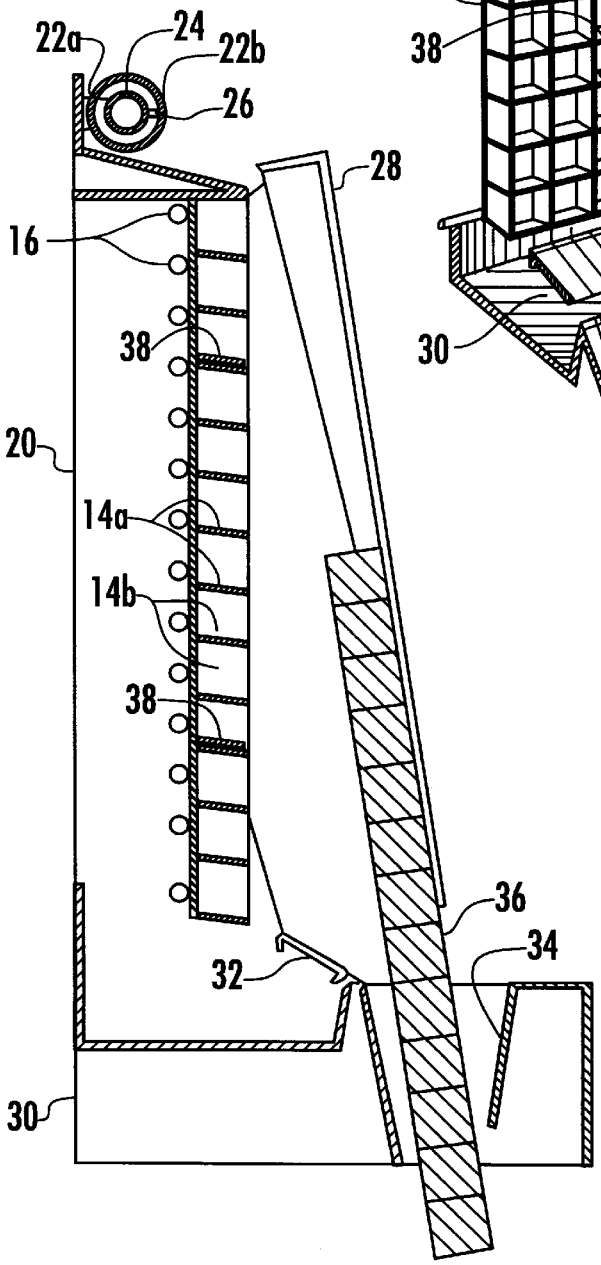
FIG. 2 is a sectional view of the ice cube making machine of FIG. 1.

Referring to FIG. 2, a sectional view of the ice cube making machine 10 of FIG. 1 shows the details of the construction of delivery tube 22. Water is supplied to inner tube 22*a* which communicates with outer tube 22*b* through holes 24. Water then flows from outer tube 22*b* through holes 26 to cascade in a "waterfall" or sheet-like flow across lattice structure 14. Water flows over the lattice structure 14 and into the individual pockets or ice cube molds 18. The evaporator plate 12 is highly conductive which causes ice to form on all the walls of the pockets 18. When the pockets 18 are completely filled with ice a series of bridges of ice forms between the individual pockets of ice to form ice cube block 36. At this point the water flow is stopped and the flow of refrigerant in the serpentine shaped refrigerant coil 16 is reversed to begin heating the evaporator plate 12. Under ideal conditions, i.e., when the evaporator plate 12 is new with a smooth surface texture, ice cube block 36 is loosened from evaporator plate 12 by a slight melting of the individual ice cubes. Owing to the downwardly sloping horizontal face of the pockets 18, gravity acts to allow ice cube block 36 to drop into guide chute 34 and thereby harvest the ice.

Figure 3:
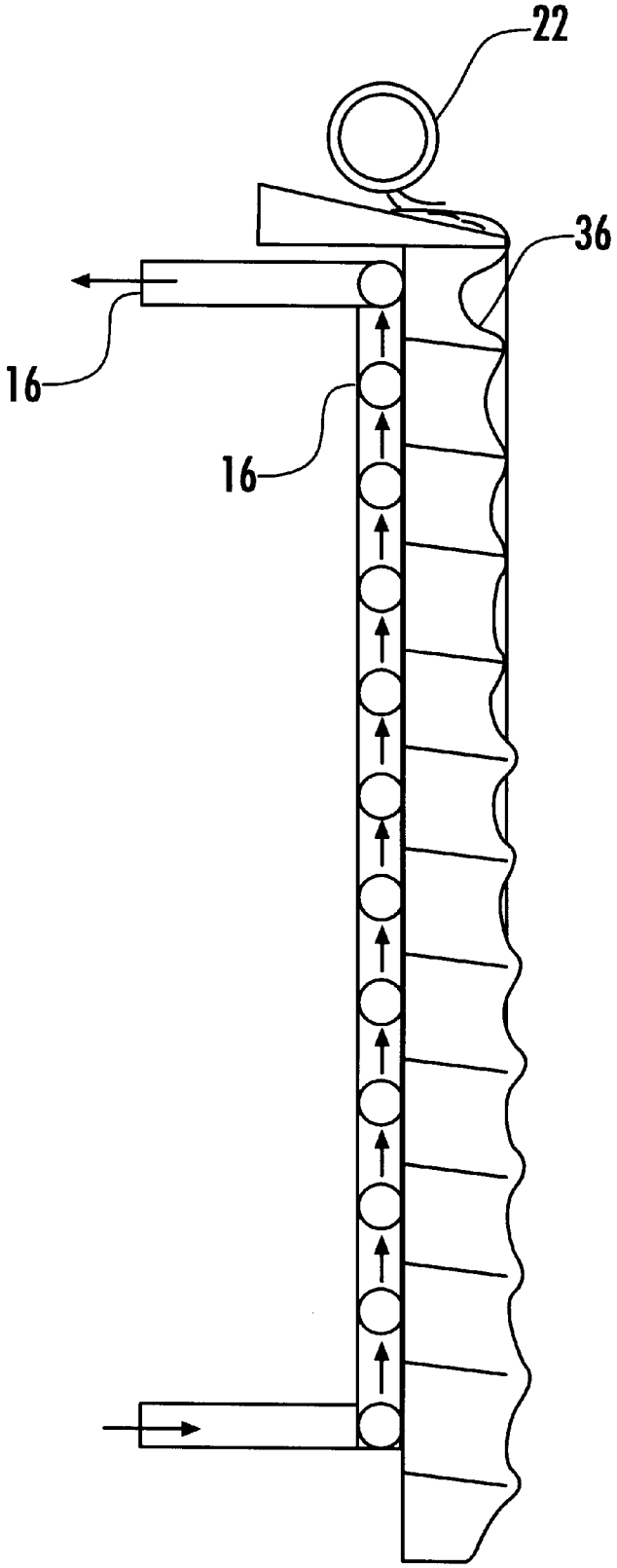
FIG. 3 (PRIOR ART)
FIG. 3 is a sectional view of a prior art ice cube making machine without the skate installed.
Figure 4:
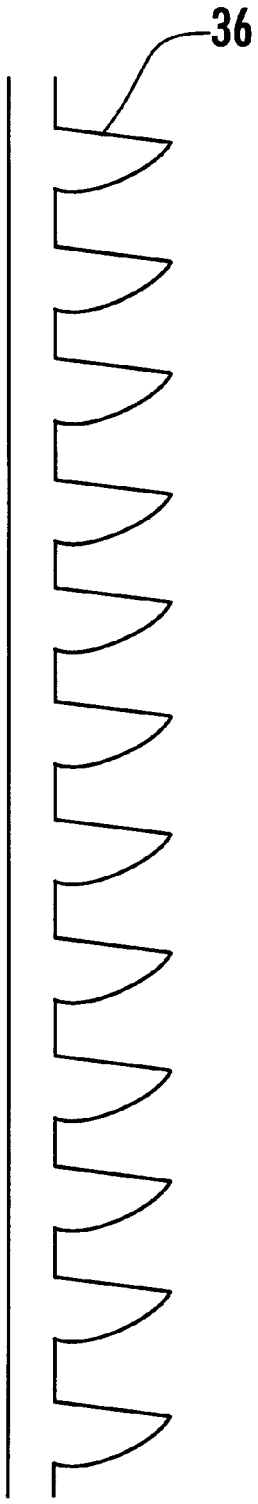
FIG. 4 (PRIOR ART)
FIG. 4 is a sectional view of a prior art ice cube making machine showing how the ice is formed.

FIG. 3 shows the condition of ice block 36 after the evaporator plate 12 has been in use for a period of time and its surface texture has begun deteriorating. In this case, prior art evaporator plates 12 cause the ice block 36 to be excessively heated causing unnecessary melting of the individual cubes. The cubes are thus malformed giving an unappetizing appearance and diminishing the output of the ice cube making machine 10. In extreme cases, more than half the cube is melted as shown in FIG. 4.

Figure 5:
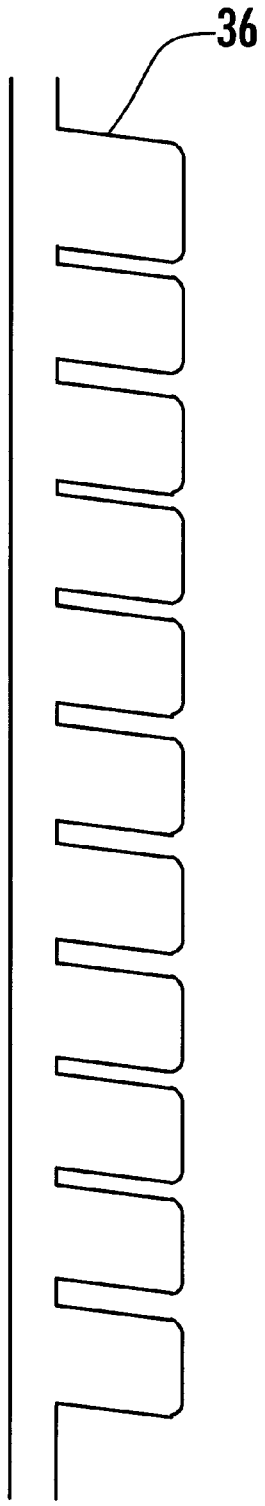
FIG. 5 is a sectional view of an ice cube making machine utilizing the skate.

Referring to FIGS. 1 and 2, skate 38 is shown placed in some of the individual pockets or ice cube molds 18. Skate 38 is a piece of low friction plastic material shaped in a square and sized to fit the lower face of the ice cube mold and typically 1/16" thick. For the typical ice cube making machine 10 with a 200 pound per day ice production rating, experimentation has shown four skates 38 are sufficient. Skates 38 are secured to the lower face of the ice cube molds 18 by a suitable water proof adhesive. Skates 38 act as an insulator between the highly conductive metal of the ice cube molds 18 and the ice block 36. A typical freezing cycle is begun with water flowing into the individual pockets or ice cube molds 18 as described previously and refrigerant flowing in serpentine shaped refrigerant coil 16. Ice block 36 is formed as noted above. At the appropriate time, refrigerant flow is reversed to begin the heating and ice harvesting cycle. As the ice is melted away from the walls of individual pockets 18, the entire weight of ice block 36 is left sitting on the four skates 38. Since the skates 38 are formed of low friction material, perfectly formed ice block 36, best seen in FIG. 5, easily slides out of lattice structure 14 and into guide chute 34.

It will be understood by those of ordinary skill in the art that while skates 38 have been shown to be square in shape, other shapes are anticipated. Experimentation has been done with skates in a rectangular shape, also. It is envisioned that a skate with a tubular shape would work equally well in a circular cross-section mold.

The construction of my improved apparatus for ice harvesting of the present invention will be readily understood from the foregoing description and it will be seen I have provided an improved apparatus for ice harvesting in commercial ice machines that use a vertically oriented evaporator plate that minimizes excessive melting of the ice cubes during harvest and restores the evaporator plate production efficiency. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. An evaporator plate for a cube ice making machine, comprising:

a flat rectangular plate with a refrigerant coil attached to one side in good heat transfer relationship;

a lattice design attached to the other side of said flat rectangular plate providing a plurality of ice cube molds;

said refrigerant coil including an input end to receive a low pressure liquid refrigerant and an output end to discharge a super heated gas/refrigerant;

a means for delivering hot gas to said refrigerant coil to harvest ice formed on said lattice structure; and, a plurality of skates disposed in said lattice structure to insulate and separate said ice formed on said lattice structure from said lattice structure to facilitate harvesting of said ice.

2. An evaporator plate for a cube ice making machine according to claim 1, wherein:

said plurality of ice cube molds in said lattice design are rectangular in cross-section.

3. An evaporator plate for a cube ice making machine according to claim 2, wherein:

said plurality of skates are rectangular flat plates sized to fit the bottom of said rectangular cross-section ice molds.

4. An evaporator plate for a cube ice making machine according to claim 3, wherein:

said plurality of skates are secured to said bottom of said rectangular cross-section ice molds by a water proof adhesive.

5. An evaporator plate for a cube ice making machine according to claim 1, wherein:

said plurality of ice cube molds in said lattice design are square in cross-section.

6. An evaporator plate for a cube ice making machine according to claim 5, wherein:

said plurality of skates are square flat plates sized to fit the bottom of said square cross-section ice molds.

7. An evaporator plate for a cube ice making machine according to claim 6, wherein:

said plurality of skates are secured to said bottom of said square cross-section ice molds by a water proof adhesive.

8. An evaporator plate for a cube ice making machine according to claim 1, wherein:

said plurality of ice cube molds in said lattice design are circular in cross-section.

9. An evaporator plate for a cube ice making machine according to claim 8, wherein:

said plurality of skates are tubular members sized to fit the interior of said circular cross-section ice molds.

10. An evaporator plate for a cube ice making machine according to claim 9, wherein:

said plurality of skates are secured to said interior of said circular cross-section ice molds by a water proof adhesive.

* * * * *